US012398612B2

(12) United States Patent
Al-Mousa et al.

(10) Patent No.: US 12,398,612 B2
(45) Date of Patent: Aug. 26, 2025

(54) AUTOMATIC WELL KILLING SYSTEM

(71) Applicant: SAUDI ARABIAN OIL COMPANY, Dhahran (SA)

(72) Inventors: Ahmed Abdulaziz Al-Mousa, Dhahran (SA); Hassan K. Al-Aswad, Dhahran (SA); Omar M. Alhamid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/194,387

(22) Filed: Mar. 31, 2023

(65) Prior Publication Data

US 2024/0328276 A1 Oct. 3, 2024

(51) Int. Cl.
*E21B 33/06* (2006.01)
*E21B 21/08* (2006.01)
*E21B 34/02* (2006.01)

(52) U.S. Cl.
CPC ..... *E21B 33/062* (2013.01); *E21B 21/08* (2013.01); *E21B 34/025* (2020.05)

(58) Field of Classification Search
CPC .... E21B 17/0853; E21B 21/10; E21B 33/062; E21B 34/025; E21B 44/00; E21B 47/06; E21B 47/10
See application file for complete search history.

(56) References Cited

U.S. PATENT DOCUMENTS

2010/0294482 A1* 11/2010 Araujo ..... E21B 33/061 166/85.4
2011/0253445 A1* 10/2011 Hannegan ..... E21B 19/006 175/5
2012/0217019 A1 8/2012 Zediker et al.
2017/0044856 A1* 2/2017 Leuchtenberg ..... E21B 21/08
2017/0138134 A1* 5/2017 Walker ..... B01F 25/21
2017/0218717 A1 8/2017 Brinsden
2018/0051549 A1* 2/2018 Holyfield ..... E21B 47/10
2018/0080317 A1* 3/2018 Hopper ..... E21B 21/08
2018/0313187 A1* 11/2018 Cummins ..... E21B 21/106

FOREIGN PATENT DOCUMENTS

AU 2012202381 A1 11/2012
CA 2927910 A1 10/2016
EP 2518261 A2 * 10/2012 ..... E21B 21/08
WO WO-02088516 A1 * 11/2002 ..... E21B 33/0355

* cited by examiner

*Primary Examiner* — Tara Schimpf
*Assistant Examiner* — Lamia Quaim
(74) *Attorney, Agent, or Firm* — Vorys, Sater, Seymour and Pease LLP

(57) ABSTRACT

A system includes a wellhead assembly installed above a well, the wellhead assembly including a passageway extending therethrough in fluid communication with the well, a sensor operable to detect a characteristic of a fluid flow in the passageway indicative of a need for a well killing operation, a kill fluid line extending between a source of kill fluid and the passageway, a hydraulic control remote (HCR) valve installed in the kill fluid line, the HCR valve including a gate movable between closed and open positions with respect to the kill fluid line and an actuator to open and close the gate, and a controller communicatively coupled to the flow sensor and the HCR valve operable to instruct the actuator of the HCR valve to open in response to determining the characteristic of the fluid flow in the passageway is indicative of a need for a well kill operation.

17 Claims, 5 Drawing Sheets

AUTOMATIC WELL KILLING SYSTEM

FIELD OF THE DISCLOSURE

The present disclosure relates generally to well killing operations and, more particularly, to automatic well killing via a modified hydraulic control remote valve and automated blowout preventer.

BACKGROUND OF THE DISCLOSURE

During drilling and hydrocarbon extraction operations in a hydrocarbon-producing well, the need may arise to prevent the flow of formation fluids to the well surface, also known as "killing" of the well. A common well killing operation involves introducing a heavy fluid (known as "kill fluid" or "kill mud") into the well in order to overcome the pressure of the formation fluids flowing from the subterranean formation and cease formation fluid flow. Well killing may be required during advanced interventions, such as workovers, or may be performed as contingency operations to prevent uncontrolled flow of the formation fluids to the surface, or blowouts.

Efforts have been made to enable remote killing of wells using a hydraulic control remote (HCR) valve in the choke or kill fluid lines near the wellhead, such that kill fluid may be allowed to flow into the well without an operator manually opening a gate valve. However, manually initiating the well killing operation, even remotely, may place the well, equipment, and personnel at risk during the detection, preparation, and execution phases of the well killing operation.

Accordingly, systems and methods for the automatic detection of problematic flow, and subsequent automatic well killing, are desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system includes a wellhead assembly installed above a well, the wellhead assembly including a passageway extending therethrough in fluid communication with the well, a sensor operable to detect a characteristic of a fluid flow in the passageway indicative of a need for a well killing operation, a kill fluid line extending between a source of kill fluid and the passageway, a hydraulic control remote (HCR) valve installed in the kill fluid line, the HCR valve including a gate movable between closed and open positions with respect to the kill fluid line and an actuator to open and close the gate, and a controller communicatively coupled to the flow sensor and the HCR valve. The controller is operable to instruct the actuator of the HCR valve to open in response to determining the characteristic of the fluid flow in the passageway is indicative of a need for a well kill operation to permit the kill fluid to enter the well through the passageway through the kill fluid line.

In another embodiment, a method includes detecting, with a sensor, a characteristic of a fluid flow through a passageway defined through a wellhead assembly, receiving, with a controller, a signal from the sensor indicative of the characteristic of the fluid flow, determining, with the controller, whether or not a predetermined set of conditions are met indicating a need for the well killing operation based on the signal, actuating one or more hydraulic control remote (HCR) valves within a kill fluid line extending from the passageway in response to determining that the predetermined set of conditions are met, and activating one or more discharge pumps installed within the kill fluid line to pump a kill fluid into the passageway through the one or more HCR valves, wherein the kill fluid is of a density to overcome a pressure of the fluid flow.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
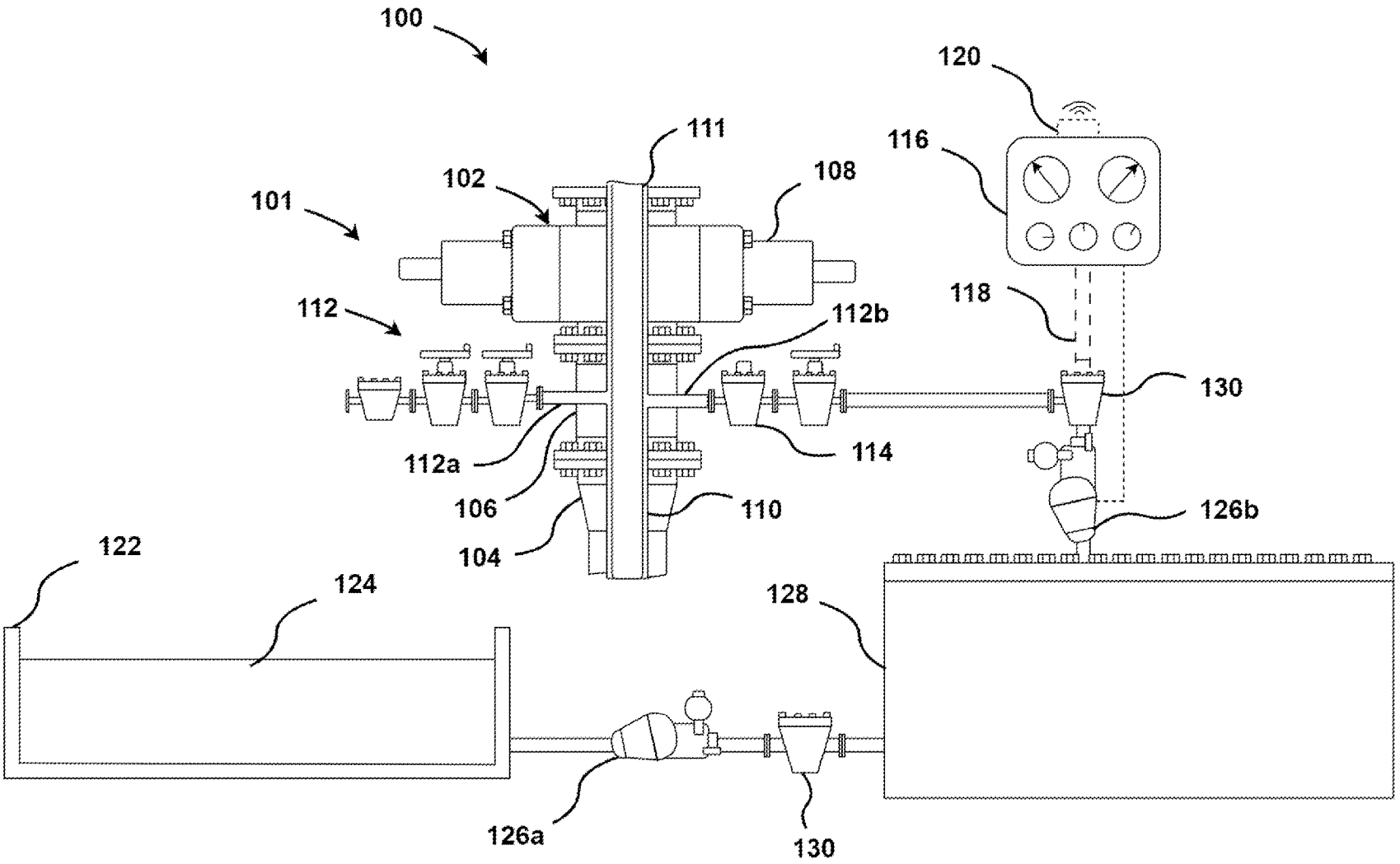
FIG. 1 is a schematic view of an example system for automatic well killing operations, according to at least one embodiment of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to well killing operations and, more particularly, to automatic well killing via a modified hydraulic control remote valve and an automated blowout preventer. The systems and methods described herein may enable automatic detection of problematic flow and an automatic initiation of well killing operations, such that a future blowout may be detected and resolved prior to the development of any danger to operators or damage to equipment. The systems and method described herein may be further installed or implemented alongside standard wellhead and blowout preventer equipment, such that the well killing automation may be retrofit into existing well systems.

FIG. 1 is a schematic view of an example system 100 for automatic well killing operations, according to at least one embodiment of the present disclosure. The system 100 includes a wellhead assembly 101, which may be installed above a well (not shown) extending through a subterranean formation. The wellhead assembly 101 may include a blowout preventer 102 (partially shown here) mated to a wellhead 104 via a spool 106. A passageway 110 may be defined through the wellhead assembly 101, which may extend through each of the blowout preventer 102, the spool 106, and the wellhead 104. The passageway 110 may be in fluid communication with the subterranean formation such that formation fluids may pass through the passageway 110. As described in greater detail below, the blowout preventer 102 and the fluids introduced through the spool 106 may facilitate the prevention of problematic flows of production fluids through the passageway 110.

In the illustrated embodiment, the passageway 110 includes piping 111 which may be production tubing, drill string, or other piping which may be run downhole through the wellhead assembly 101. One or more rams 108, either blind rams, pipe rams or shear rams, of the blowout preventer 102 may abut the passageway 110. The one or more rams 108 may be actuated prior to a well killing operation such that further flow of formation fluids to the surface may be obstructed or sealed through blockage or shearing of the passageway 110 or the piping 111.

The spool 106 may additionally contain internal components such that the spool 106 is a casing head spool or a tubing head spool for further operations. The spool 106 may be mated to, or otherwise in fluid communication with, a mud cross 112 of the wellhead assembly 101. The mud cross 112 is formed of a series of valves to control a choke line 112*a* and kill fluid lines 112*b* extending from the passageway 110. One or more of the valves of the mud cross 112 may be the modified hydraulic control remote (HCR) valves 114, wherein an internal gate may be raised into the valve bonnet remotely in response to a control signal, such as an electronic signal or another type of control signal.

The electronic or other control signal may be autonomously provided. To this effect, the system 100 may further include a controller, such as control panel 116, which may control the operations of the various valves, including the modified HCR valves 114, and the one or more rams 108. The control panel 116 may be communicatively coupled to the remainder of the system 100 via one or more physical cables 118. In at least one embodiment of the present disclosure, however, the control panel 116 may include a wireless communication component 120 which enables the control panel 116 to be portable in nature. The wireless communication component 120 may communicate with the remainder of the system 100 via Wifi, bluetooth, infrared, radio frequency, or any other available wireless communication technology.

The system 100 may include a kill tank 122 in fluid communication with the wellhead assembly 101, such that a kill fluid 124 may be mixed and prepared prior to an active well killing operation. As illustrated, the kill tank 122 may be open such that the kill fluid 124 may be produced, tested, and modified. The kill fluid 124, once prepared, may be pumped through a first discharge pump 126*a*, such that the kill fluid 124 is directed into an isolated kill tank 128. The isolated kill tank 128 may be closed and sealed such that the kill fluid 124 may be stored, maintained, and pressurized in preparation for a well killing operation. During a well killing operation, the kill fluid 124 stored in the isolated kill tank 128 may be pumped to the mud cross 112 using a second discharge pump 126*b*. Following the opening of the modified HCR valves 114, the kill fluid 124 may be injected into the passageway 110 and may flow into the wellhead 104. The density of the kill fluid 124 allows the kill fluid 128 to overcome the production pressure of the formation fluid, such that the flow of formation fluid to the well surface ceases and the well is effectively killed.

The fluid connections between the kill tank 122, the isolated kill tank 128, and the mud cross 112 may include one or more one-way valves 130 interposed within the fluid connections. The one-way valves 130 may prevent backflow of formation fluids into the isolated kill tank 128 or the kill tank 122, while allowing the kill fluid 124 to be pumped to the mud cross 112.

The system 100 may enable near-instantaneous killing of the well during blowout events, prior to the presence of danger or damage, and may be fully automated to overcome human error. In some embodiments, the system 100 may be employed in a well killing operation prior to advanced workover, such that the system 100 is manually triggered but automatically performs the well killing operation. The system 100 may be triggered by the control panel 116, or a remote control device, such that an operator may relocate to a safe distance prior to initiating the well killing operation. The system 100 may thus increase safety associated with both planned and unplanned well killing operations, while adding a layer of automatic blowout prevention to prevent equipment damage and operator harm.

Figure 2:
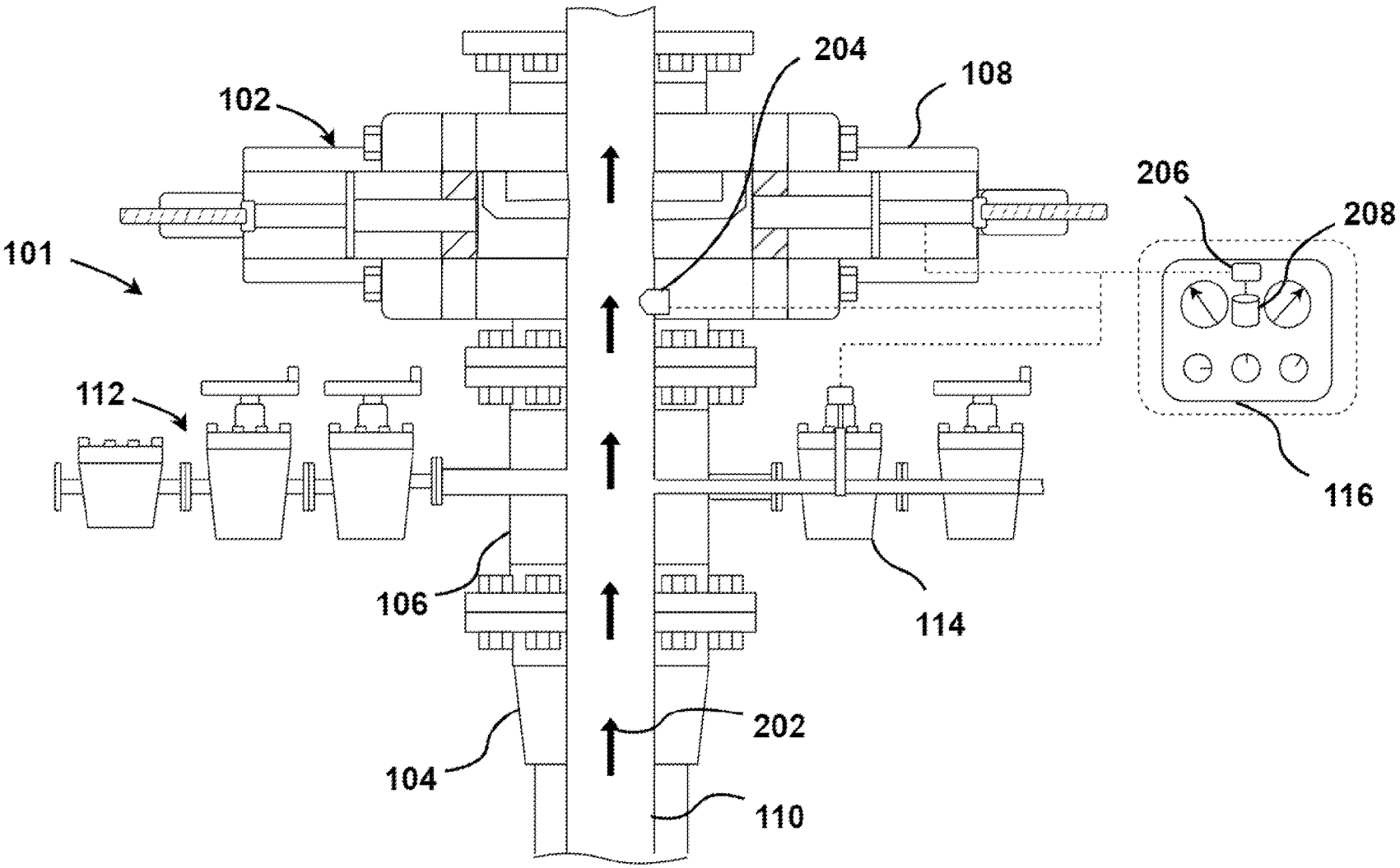
FIGS. 2-4 are partial cross-sectional views of the system of FIG. 1 in progressive stages of an example automatic well killing operation.

Example operation of the system 100 will now be described with reference to FIGS. 2-4, which depict progressive cross-sectional views before and during an automatic well killing operation in the wellhead assembly 101. In FIG. 2, formation fluid 202 is flowing through the passageway 110. The presence and flowrate of the formation fluid 202 may be detected by a sensor 204, which may be installed within the blowout preventer 102 as illustrated or at other locations within or abutting the passageway 110. In some embodiments, the sensor 204 is an ultrasonic sensor clamped onto an outer wall of the passageway 110 or an outer wall of the piping 111 of FIG. 1. In these embodiments, the sensor 204 may detect a flowrate or quantity of formation fluid 202 entering from below. The quantity, flowrate, or rate of change of flowrate for the formation fluid 202 may be compared against threshold values to determine the need for a killing operation. In alternate embodiments, the sensor 204 may be a mechanical sensor, an electromagnetic sensor, or any other device which may detect abnormal flow within the passageway 110, abnormal flow within the piping 111 of FIG. 1, or conditions indicative of the need for a killing operation.

The sensor 204 may communicate with a processor 206 with a signal regarding the flow of formation fluid 202. In some embodiments, the processor 206, as illustrated, may be a component of the control panel 116, such that device control is further implemented by the control panel 116. In alternate embodiments, however, the processor 206 may be part of a standalone device or incorporated into any automated device within the system 100 of FIG. 1. The processor 206 may be installed with, or otherwise communicatively coupled to, a memory 208 on which an algorithm, or instructions, are stored for the processor 206 to perform (execute). The memory 208 may further include a database of the sensor readings and data associated with actions taken during the well killing operations.

The processor 206 may receive a reading or a flagging signal from the sensor 204, and may subsequently determine whether the flow of the formation fluid 202 requires a well killing operation. The processor 206 may evaluate the reading or flagging signal to determine whether or not a predetermined set of conditions are met indicating a need for the well killing operation. In a non-limiting example, the processor 206 may determine that a well killing operation is necessary when more than five barrels of formation fluid 202 have been detected by the sensor 204. In some embodiments, the processor 206 may have a pre-loaded algorithm or module for the determination of, and performance of, a well killing operation. As illustrated, the processor 206 may be in communication with the sensor 204, the modified HCR valve 114, and the blowout preventer 102 (or the one or more rams 108) for facilitating the well killing operation.

Figure 3:
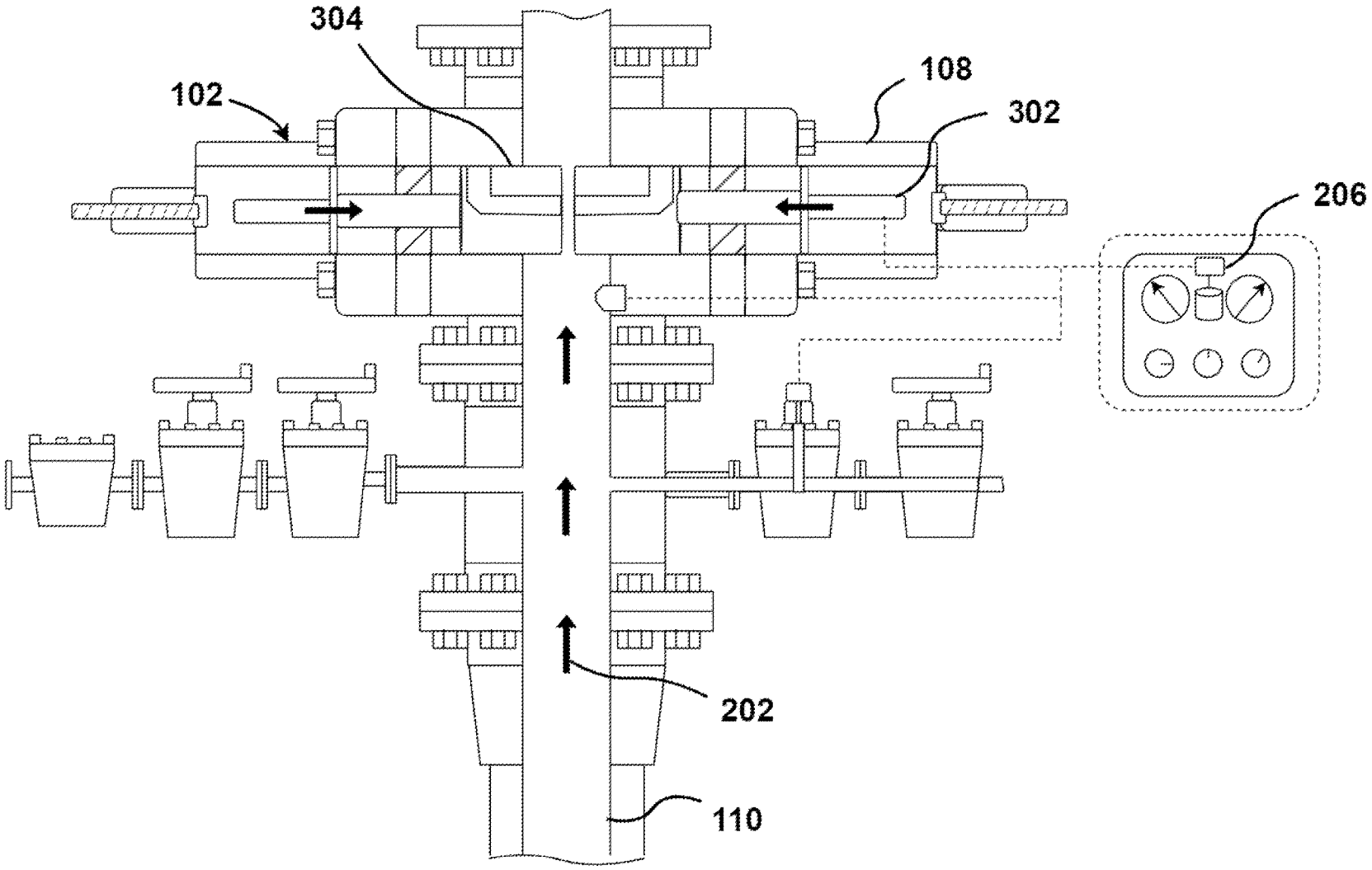

In FIG. 3, the processor 206 has instructed the various components of the system 100 of FIG. 1 to begin the well killing operation. Accordingly, the blowout preventer 102 and, more particularly, the one or more rams 108 have been activated to seal off flow through a top of the passageway 110, or the piping 111 of FIG. 1. The one or more rams 108 may be actuated, such that the internal rams 302 begin travelling inwards toward the passageway 110. In some embodiments, the one or more rams 108 may be hydraulically actuated to overcome internal pressures or materials interspersed between the internal rams 302. The internal rams 302 may continue to travel until the passageway 110 is completely cut, sealed, or compressed. In some embodiments, the one or more rams 108 may be shear rams, such that any pipe or tubing forming, or disposed within, the passageway 110 is sheared and the ram heads 304 may mate to form a seal over the damaged passageway 110. In alternate embodiments, the one or more rams 108 may be blind rams, such that the ram heads 304 may meet within the passageway 110 and form a plug or cover within the passageway 110 and prevents further flow. In other embodiments, the one or more rams 108 may be pipe rams, such that the ram heads 304 form an annular seal around a drill pipe, production tubing, coiled tubing, or other tubular (e.g., the tubing 111 of FIG. 1) extending through the flow path 110. Those skilled in the art will readily appreciate that other forms of rams may be utilized in the scaling of the passageway 110 within the blowout preventer 102 such that further flow of formation fluid 202 is prevented, without departing from the scope of this disclosure.

Figure 4:
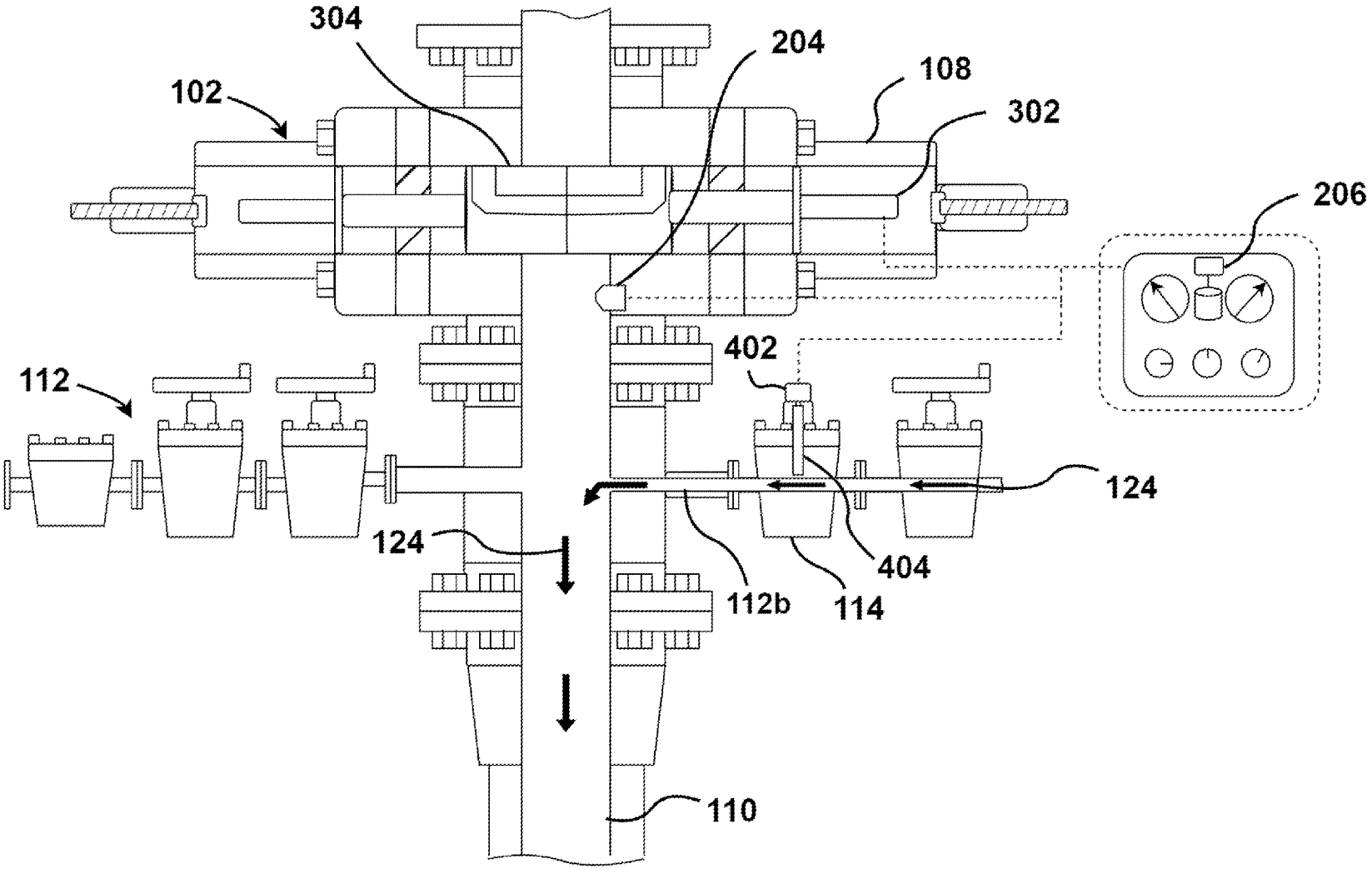

In FIG. 4, the internal rams 302 have fully travelled such that the ram heads 304 have created a blockage within the blowout preventer 102, thus preventing further flow of the formation fluid 202 of FIGS. 2-3. In some embodiments, the one or more rams 108 may transmit a closure signal to the processor 206 signifying a completed seal. In further embodiments, the sensor 204 may transmit a closure signal to the processor 206 signaling a drop in, or cessation of, flow past the sensor 204 to indicate that the passageway 111 has been completely sealed. The processor 206 may delay instructing the HCR valve 114 until the closure signal has been received. Once the processor 206 has received confirmation of the sealing within the blowout preventer 102, or has paused execution long enough after signaling for actuation of the one or more rams 108, the modified HCR valve 114 may be instructed to open.

A hydraulic actuation mechanism 402 of the HCR valve 114 may be instructed, or directly controlled, by the processor 206 to begin upward travel of the gate 404 into the bonnet of the modified HCR valve 114. As the gate 404 is retracted into the bonnet of the modified HCR valve 114, the kill fluid 124 may be pumped through the kill fluid line **112*b* of the mud cross 112 and into the passageway 110. The kill fluid 124 may begin to mix with, or displace the remaining formation fluid 202 of FIGS. 2-3, and may begin to travel down through the wellhead 104. The kill fluid 124 may flow through the passageway 110 until reaching the subterranean formation, or may flow until a sufficient hydrostatic head is formed above the formation fluid 202 of FIGS. 2-3**. The formed hydrostatic head may be heavy or dense enough to overcome the upward pressure from the subterranean formation below, thus preventing further upward flow from the subterranean formation, thus killing the well.

The operations described in the discussion of FIGS. 2-4 may be fully automated in operation, such that the detection of formation fluid 202 of FIGS. 2-3, the sealing of the passageway 110 via the one or more rams 108, the opening of the modified HCR valve 114, and the pumping of kill fluid 124 into the well are all automatically initiated and performed. The automation of the well killing operations may enable near-instantaneous resolution of blowout events before damage or danger may occur, and may ensure all proper steps are taken in the well killing process. The automated process may eliminate human error in the well killing operation, but may also enable operators to reach a safe distance from the well during the possibly hazardous event.

In view of the foregoing structural and functional description, those skilled in the art will appreciate that portions of the embodiments may be embodied as a method, data processing system, or computer program product. Accordingly, these portions of the present embodiments may take the form of an entirely hardware embodiment, an entirely software embodiment, or an embodiment combining software and hardware, such as shown and described with respect to the computer system of FIG. 5. Furthermore, portions of the embodiments may be a computer program product on a computer-readable storage medium having computer readable program code on the medium. Any non-transitory, tangible storage media possessing structure may be utilized including, but not limited to, static and dynamic storage devices, volatile and non-volatile memories, hard disks, optical storage devices, and magnetic storage devices, but excludes any medium that is not eligible for patent protection under 35 U.S.C. § 101 (such as a propagating electrical or electromagnetic signals per se). As an example and not by way of limitation, computer-readable storage media may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, as appropriate.

Certain embodiments have also been described herein with reference to block illustrations of methods, systems, and computer program products. It will be understood that blocks and/or combinations of blocks in the illustrations, as well as methods or steps or acts or processes described herein, can be implemented by a computer program comprising a routine of set instructions stored in a machine-readable storage medium as described herein. These instructions may be provided to one or more processors of a general purpose computer, special purpose computer, or other programmable data processing apparatus (or a combination of devices and circuits) to produce a machine, such that the instructions of the machine, when executed by the processor, implement the functions specified in the block or blocks, or in the acts, steps, methods and processes described herein.

These processor-executable instructions may also be stored in computer-readable memory that can direct a computer or other programmable data processing apparatus to function in a particular manner, such that the instructions stored in the computer-readable memory result in an article of manufacture including instructions which implement the function specified. The computer program instructions may also be loaded onto a computer or other programmable data processing apparatus to cause a series of operational steps to be performed on the computer or other programmable apparatus to realize a computer implemented process such that the instructions which execute on the computer or other programmable apparatus provide steps for implementing the functions specified in flowchart blocks that may be described herein.

Figure 5:
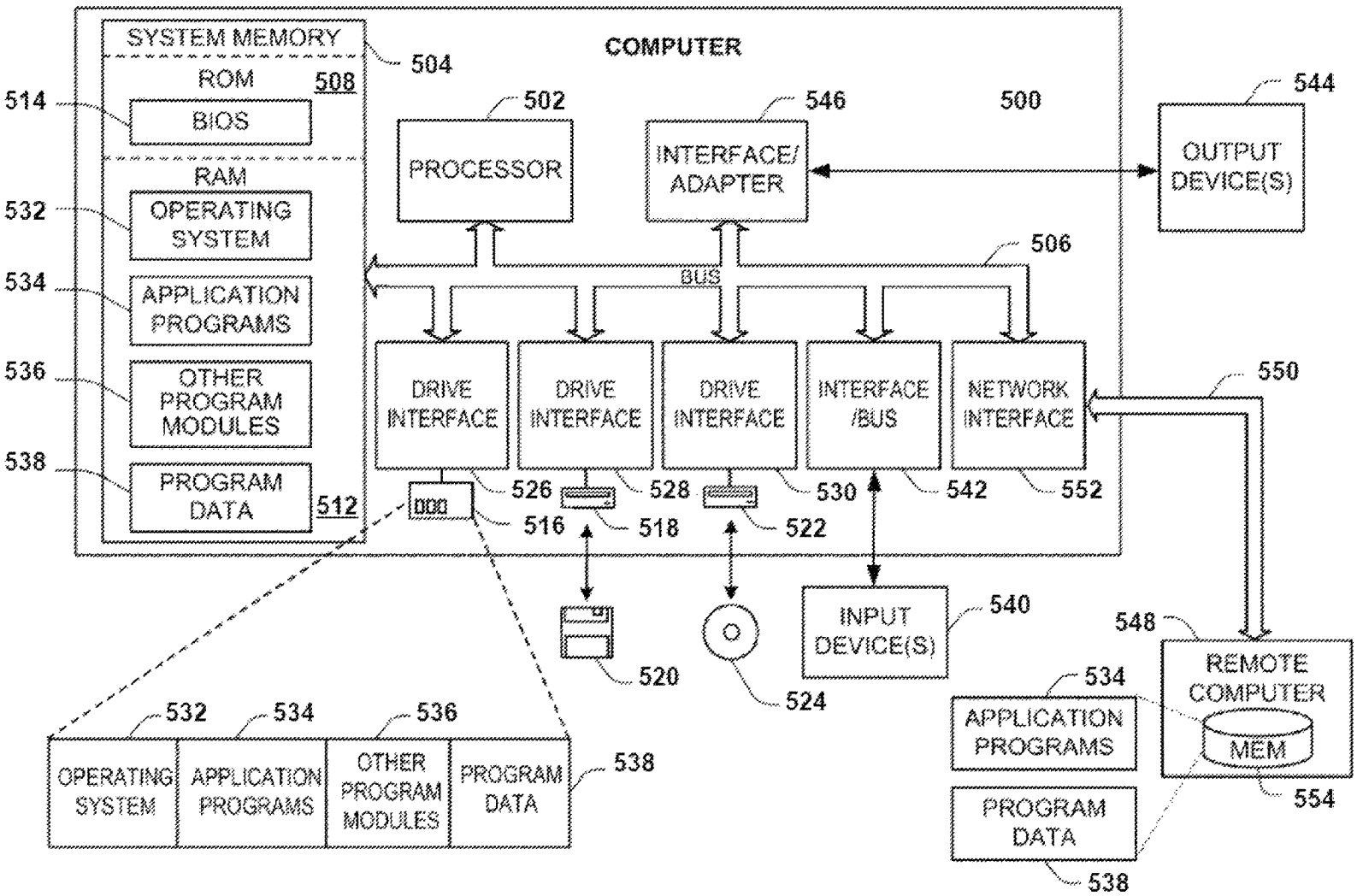
FIG. 5 is a schematic diagram of an example of a computer system that can be employed to execute one or more embodiments of the present disclosure.

In this regard, FIG. 5 illustrates one example of a computer system 500 that can be employed to execute one or more embodiments of the present disclosure. Computer system 500 can be implemented on one or more general purpose networked computer systems, embedded computer systems, routers, switches, server devices, client devices, various intermediate devices/nodes or standalone computer systems. Additionally, computer system 500 can be implemented on various mobile clients such as, for example, a personal digital assistant (PDA), laptop computer, pager, and the like, provided it includes sufficient processing capabilities.

Computer system 500 includes processing unit 502, system memory 504, and system bus 506 that couples various system components, including the system memory 504, to processing unit 502. System memory 504 can include volatile (e.g. RAM, DRAM, SDRAM, Double Data Rate (DDR) RAM, etc.) and non-volatile (e.g. Flash, NAND, etc.) memory. Dual microprocessors and other multi-processor architectures also can be used as processing unit 502. System bus 506 may be any of several types of bus structure including a memory bus or memory controller, a peripheral bus, and a local bus using any of a variety of bus architectures. System memory 504 includes read only memory (ROM) 510 and random access memory (RAM) 512. A basic input/output system (BIOS) 514 can reside in ROM 510 containing the basic routines that help to transfer information among elements within computer system 500.

Computer system 500 can include a hard disk drive 516, magnetic disk drive 518, e.g., to read from or write to removable disk 520, and an optical disk drive 522, e.g., for reading CD-ROM disk 524 or to read from or write to other optical media. Hard disk drive 516, magnetic disk drive 518, and optical disk drive 522 are connected to system bus 506 by a hard disk drive interface 526, a magnetic disk drive interface 528, and an optical drive interface 530, respectively. The drives and associated computer-readable media provide nonvolatile storage of data, data structures, and computer-executable instructions for computer system 500. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and ROM 510, including operating system 532, one or more application programs 534, other program modules 536, and program data 538. In some examples, the application programs 534 can include detection of the formation fluid 202, actuation of the one or more rams 108, opening of the modified HCR valve 114, or pumping of the kill fluid 124, and the program data 538 can include the flowrate determined by the sensor 204, or time since actuation of the one or more rams 108. The application programs 534 and program data 538 can include functions and methods programmed to automatically detect blowout events and initiate well killing operations without operator intervention, such as shown and described herein.

A user may enter commands and information into computer system 500 through one or more input devices 540, such as a pointing device (e.g., a mouse, touch screen), keyboard, microphone, joystick, game pad, scanner, and the like. For instance, the user can employ input device 540 to edit or modify flow parameters for automatic detection of a blowout event, or to manually initiate a well killing operation for an advanced workover. These and other input devices 540 are often connected to processing unit 502 through a corresponding port interface 542 that is coupled to the system bus, but may be connected by other interfaces, such as a parallel port, serial port, or universal serial bus (USB). One or more output devices 544 (e.g., display, a monitor, printer, projector, or other type of displaying device) is also connected to system bus 506 via interface 546, such as a video adapter.

Computer system 500 may operate in a networked environment using logical connections to one or more remote computers, such as remote computer 548. Remote computer 548 may be a workstation, computer system, router, peer device, or other common network node, and typically includes many or all the elements described relative to computer system 500. The logical connections, schematically indicated at 550, can include a local area network (LAN) and/or a wide area network (WAN), or a combination of these, and can be in a cloud-type architecture, for example configured as private clouds, public clouds, hybrid clouds, and multi-clouds. When used in a LAN networking environment, computer system 500 can be connected to the local network through a network interface or adapter 552. When used in a WAN networking environment, computer system 500 can include a modem, or can be connected to a communications server on the LAN. The modem, which may be internal or external, can be connected to system bus 506 via an appropriate port interface. In a networked environment, application programs 534 or program data 538 depicted relative to computer system 500, or portions thereof, may be stored in a remote memory storage device 554.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system comprising:

a wellhead assembly installed above a well and including a blowout preventer comprising one or more rams, wherein a passageway extends through the wellhead assembly and is in fluid communication with the well;

a sensor mounted to an interior wall of the passageway and operable to detect a characteristic of a fluid flow in the passageway indicative of a need for a well killing operation;

a kill fluid line extending between a source of kill fluid and the passageway;

a hydraulic control remote (HCR) valve installed in the kill fluid line and including a gate movable between closed and open positions with respect to the kill fluid line and an actuation mechanism operable to open and close the gate; and a controller communicatively coupled to the sensor and the actuation mechanism, the controller operable to control the actuation mechanism to open the gate in response to detection of the characteristic of the fluid flow in the passageway indicative of the need for a well kill operation to thereby permit the kill fluid to enter the well through the kill fluid line and the passageway, wherein the controller communicates with the blowout preventer to actuate the one or more rams, and wherein the controller opens the gate after receiving a closure signal from the blowout preventers indicating actuation of the one or more rams.

2. The system of claim 1, further comprising one or more discharge pumps installed within the kill fluid line, wherein the controller is communicatively coupled to the one or more discharge pumps and operable to instruct activation of the one or more discharge pumps subsequent to the actuation of the one or more rams.

3. The system of claim 2, wherein the controller autonomously and directly controls the actuation mechanism, the blowout preventer, and the one or more discharge pumps in response to detection of the characteristic of the fluid flow in the passageway indicative of the need for a well kill operation.

4. The system of claim 1, wherein the source of kill fluid comprises:

a mixing tank arranged adjacent the wellhead assembly for preparing the kill fluid;

an isolated kill tank in fluid communication with the mixing tank and fluidly coupled to the kill fluid line, the isolated kill tank receiving the kill fluid from the mixing tank and being closed and sealed such that the kill fluid is stored, maintained, and pressurized in preparation for the well killing.

5. The system of claim 4, further comprising one or more one-way valves interposed within the kill fluid line and operable to prevent the fluid flow in the passageway from entering the isolated kill tank.

6. The system of claim 1, wherein the sensor is an ultrasonic flow sensor.

7. The system of claim 1, wherein the controller comprises a memory, wherein the memory stores an algorithm for performing the well killing operation, data from the sensor, operational data of the HCR valve, or a combination thereof.

8. The system of claim 1, wherein the actuation mechanism is a hydraulic actuation mechanism operable to automatically open the gate in response to detection of the characteristic of the fluid flow in the passageway indicative of the need for a well kill operation.

9. A method comprising:

detecting, with a sensor, a characteristic of a fluid flow through a passageway defined through a wellhead assembly, the wellhead assembly including a blowout preventer with one or more rams, and the sensor being mounted to an interior wall of the passageway;

receiving, with a controller, a signal from the sensor indicative of the characteristic of the fluid flow;

determining with the controller, and based on the signal, whether or not a predetermined set of conditions is met indicating a need for a well killing operation;

sealing the passageway through the wellhead assembly by activating the one or more rams;

receiving, with the controller, a closure signal indicating that the sealing of the passageway is complete, the closure signal being provided by at least one of the blowout preventer and the sensor;

actuating, via an actuation mechanism controlled by the controller, a gate of one or more hydraulic control remote (HCR) valves within a kill fluid line extending from the passageway in response to receiving the closure signal; and activating one or more discharge pumps installed within the kill fluid line to pump a kill fluid to overcome a pressure of the fluid flow into the passageway through the one or more HCR valves.

10. The method of claim 9, wherein sealing the passageway through the wellhead assembly is performed prior to actuating the one or more HCR valves.

11. The method of claim 9, wherein activating the one or more discharge pumps is preceded by:

mixing and preparing the kill fluid within a kill tank arranged adjacent the wellhead assembly;

conveying the kill fluid to an isolated kill tank in fluid communication with the kill tank, the isolated kill tank being closed and sealed; and pressurizing the kill fluid within the isolated kill tank in preparation for the well killing operation.

12. The method of claim 9, wherein detecting the characteristic of the fluid flow includes operating an ultrasonic flow sensor.

13. The method of claim 12, further comprising disposing piping through the passageway, wherein the piping comprises drill pipe, production tubing, or coiled tubing, and wherein operating the ultrasonic flow sensor includes detecting the flow within the piping.

14. The method of claim 9, wherein the actuation mechanism is a hydraulic actuation mechanism, and wherein actuating the one or more HCR valves comprises hydraulically retracting the gate of the one or more HCR valves into a bonnet of the one or more HCR valves.

15. The method of claim 9, further comprising wirelessly communicating, via a wireless communication component of the controller, with the actuation mechanism, the sensor, and the one or more discharge pumps to remotely control operation thereof.

16. A system comprising:

a wellhead assembly including a passageway extending therethrough and in fluid communication with a well;

a sensor mounted to an interior wall of the passage and operable to detect a characteristic of a fluid flow in the passageway indicative of a need for a well killing operation;

a blowout preventer comprising one or more rams operable to block and/or shear the passageway;

a kill fluid line extending between a source of kill fluid and the passageway;

one or more discharge pumps installed within the kill fluid line and operable to pump the kill fluid through the kill fluid lines;

a hydraulic control remote (HCR) valve installed in the kill fluid line and including an actuation mechanism operable to remotely open and close a gate of the HCR valve; and a controller communicatively coupled to the sensor, the actuation mechanism, and the blowout preventer, wherein the controller is operable to remotely control the actuation mechanism, the one or more discharge pumps, and the one or more rams of the blowout preventer in response to detection of the characteristic of the fluid flow in the passageway indicative of the need for a well kill operation, and wherein the controller opens the gate after receiving a closure signal from the blowout preventer indicating actuation of the one or more rams.

17. The system of claim 16, wherein the actuation mechanism is a hydraulic actuation mechanism operable to raise and lower the gate of the HCR valve upon receiving a signal from the controller.

* * * * *